United States Patent [19]

Ellison

[11] Patent Number: 4,791,960

[45] Date of Patent: Dec. 20, 1988

[54] SEMI-PILOT OPERATED FOUR-WAY VALVE

[75] Inventor: John E. Ellison, Mayfield Heights, Ohio

[73] Assignee: Parker-Hannifin Corporation, Cleveland, Ohio

[21] Appl. No.: 76,501

[22] Filed: Jul. 22, 1987

[51] Int. Cl.[4] ..... F15B 13/043

[52] U.S. Cl. ..... 137/596.17; 137/596.18; 137/625.64

[58] Field of Search ..... 137/596.17, 596.18, 137/625.64

[56] References Cited

U.S. PATENT DOCUMENTS

| | | | |
|---|---|---|---|
| 3,269,417 | 8/1966 | Lansky et al. | 137/628.64 |
| 3,522,821 | 8/1970 | Komendera | 137/625.64 X |
| 3,814,133 | 6/1974 | Veh | 137/596.17 X |
| 4,639,196 | 1/1987 | Kirkland | 251/63.5 X |

OTHER PUBLICATIONS

Bulletin 8345—Automatic Switch Co. 1980.

*Primary Examiner*—Gerald A. Michalsky
*Attorney, Agent, or Firm*—Joseph B. Balazs

[57] ABSTRACT

A four-way fluid valve combines direct solenoid operation of one port with pilot valve operation of a second port and a common exhaust port, all of the ports being located in the valve body. Direct valve operation is achieved by a magnetically operated plunger carrying a normally closed valve element and operable to move a separate valve holder carrying a normally open valve element. A pilot operated valve disc is supported at the inlet port for axial movement to inlet or exhaust positions in response to inlet pressure or a pilot-operated piston.

4 Claims, 2 Drawing Sheets

SEMI-PILOT OPERATED FOUR-WAY VALVE

BACKGROUND OF THE INVENTION

This invention relates to solenoid valves for controlling fluid flow and more particularly to an improved form of four-way solenoid valve which combines direct solenoid operation with a pilot operated valve.

There are many varieties of solenoid valves designed for four-way valve operation which might be typically used to operate double acting cylinders and similar devices. Certain of these valves fall into a category known as midget valves, which valves are extremely small and utilized where space and weight considerations are significant and where fairly light loads are encountered. Since both air and liquid applications are typical, it is necessary to accommodate both inlet and exhaust flows and suitable piping is conventionally employed for the purpose. Further, although the valves are primarily designed for the light service application, variations thereof in larger and sturdier enclosures are commonly included for general purpose applications.

One particular form of prior art valve in this category utilizes a body of forged brass which includes a pressure port, a pair of cylinder ports and an exhaust port and requires that a further exhaust port be established through the solenoid valve assembly. In this prior art design a pilot valve is piston-operated, causing axial movement of a valve disc between normally open and closed positions. The direct operated valve portion is configured as a double-ended solenoid plunger which carries spring-loaded valving elements at each end for cooperation with one valve seat in the body and the other in the pole piece of the solenoid assembly. A separate exhaust passage is formed through the pole piece and typically plumbing is required at this location for routing the exhaust flow.

In this prior art design the piston-operated valve is provided with sufficient radial disc clearance to allow adequate flow to and from a cylinder port, but this tends to provide poor guidance for the piston-operated valve disc. Accordingly, the disc is not assured of repetitive seating onthe same impression in its resilient surface. Further, since lateral passages are provided in the body casting at this location, any eccentric positioning of the pilot valve disc may create partial blockages and a restriction for the flow of fluid.

The requirement for a second exhaust port in this prior art design necessitates the stocking of specialized solenoid valve parts in addition to standard solenoid parts which are typically used in many varieties of valves. Further, additional piping or muffling may be required in this design because of the second exhaust port. Finally, this type of design tends to place limitations on the exhaust orifice size and pressure rating which may produce compromises for the electromagnetic valve operator.

SUMMARY OF THE INVENTION

The deficiencies of the noted prior art valve are overcome to a great extent in the valve design of this invention. Here, a valve body includes a pair of cylinder ports, an inlet port for pressurized fluid and a common exhaust port connectable internally to each of the cylinder ports. A pilot operated valve is supported for axial movement by an integral pilot valve stem slidably received in an inlet bore forming the normally open pilot valve seat. A pilot operated piston serves to move the valve against inlet pressure bias from the normally closed pilot valve seat formed in the valve body to the normally open seat and connect one of the cylinder ports to the exhaust port.

Normally closed and normally open direct valve seats are formed in the valve body in aligned upper and lower vertical bores for actuation by the solenoid operator. An upper valve element is carried by the reciprocable plunger which is spring biased to a normally closed position, while a lower valve element is carried for movement with the plunger in a valve holder for cooperation with the normally open direct valve seat in the lower portion of the valve body. The valve holder is spring biased upwardly for engagement with the solenoid plunger assembly, being guided vertically in its movement and contacting the plunger assembly by means of an integral pair of legs which straddle a horizontal central bore in the valve body. The direct-operated valves thus alternately connect the second of the cylinder ports to the source of pressurized fluid and the exhaust port. In addition to supplying exhausting pressurized fluid to the second cylinder port, the direct-operated valves pressurize and exhaust the piston which positions the pilot-operated valve.

DESCRIPTION OF THE PREFERRED EMBODIMENT

Figure 1:
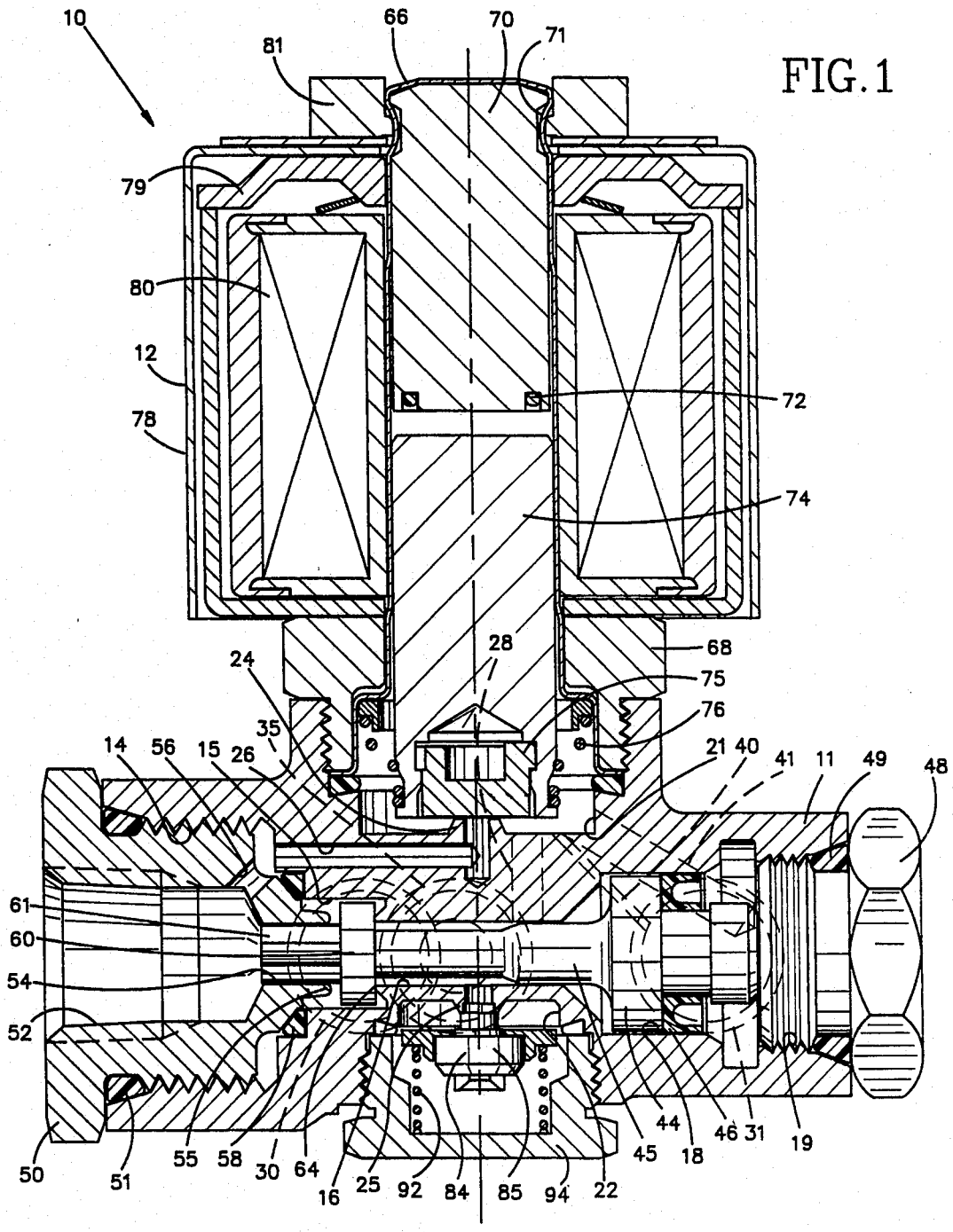
FIG. 1 is an elevational view in cross-section of the solenoid valve of the invention, shown in the deenergized position.
Figure 2:
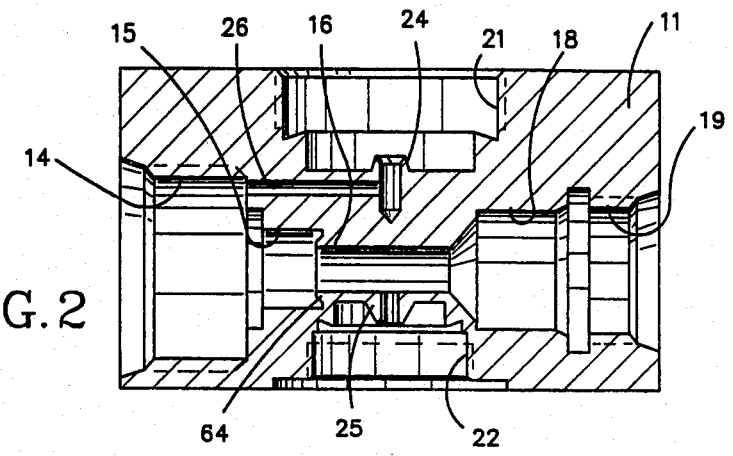
FIG. 2 is an elevational view in cross-section of only the valve body of the solenoid valve of FIG. 1.

Referring now to the drawings, the solenoid valve 10 of the invention is shown in FIG. 1 in cross-section as comprising valve body 11 and electromagnetic solenoid assembly 12 joined together to provide actuation of valving components therein. Valve body 11 comprises a brass forging having a stepped bore therethrough on a horizontal axis which bore in turn comprises relatively large threaded inlet bore 14, smaller pilot valve bore 15, still smaller central bore 16, enlarged pilot piston bore 18, and further enlarged threaded end bore 19. Valve body 11 further includes aligned upper 21 and lower 22 vertical bores. As possibly best seen in the sectional view of FIG. 2 with parts removed, upper bore 21 includes upper valve seat 24 therein while lower vertical bore 22 includes lower valve seat 25. Upper valve seat 24 is in fluid communication with inlet bore 14 by means of passage 26. Lower valve seat 25 is in fluid communication with central bore 16 by means of a short connecting passage. Further, upper bore 21 is in fluid communication with lower bore 22 by means of offset vertical passage 28.

Figure 3:
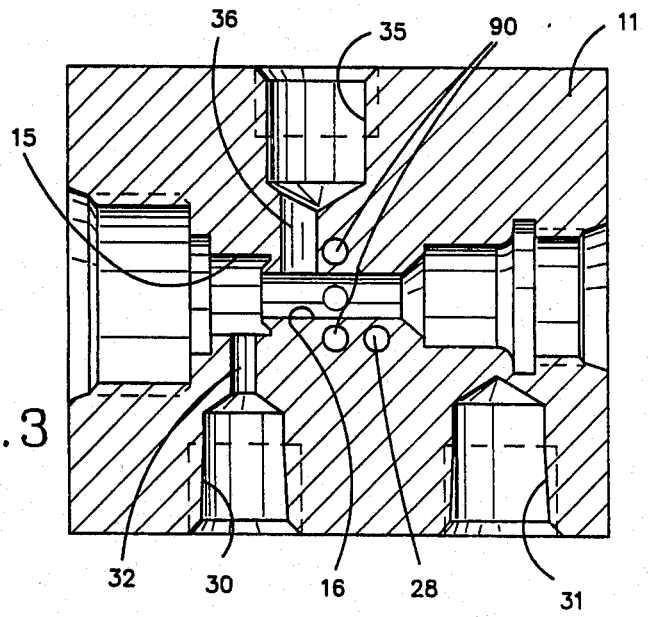
FIG. 3 is a top view in cross-section of only the valve body of the solenoid valve of FIG. 1.

With reference to FIG. 3, valve body 11 further comprises first cylinder port 30 and second cylinder port 31, both being located on the near side of valve body 11 with first cylinder port 30 in fluid communication with pilot valve bore 15 by way of passage 32. Exhaust port 35 is located on the far side of valve body 11 in alignment with central bore 16 and in fluid communication therewith by means of passage 36. In the view of the valve of FIG. 1, first and second cylinder ports 30, 31 and exhaust port 35 are depicted by dashed lines and will be understood to be located in the near and far sides of valve body 11 as described. Further as shown in dashed lines in FIG. 1, second cylinder port 31 is in fluid communication with upper vertical bore 21 by means of restricted cylinder passage 40 while piston bore 18 is in fluid communication with upper vertical bore 21 by means of a larger passage 41.

A pilot valve piston 44 is slidably received in piston bore 18 and includes stem 45 closely received in central bore 16 and extending therethrough to pilot valve bore 15. Piston stem 45 is reduced at its left end as viewed in FIG. 1 to provide clearance for fluid flow through central passage 16. A piston U-cup 46 is supported on piston head 44 and provides sealing engagement with piston bore 18. End plug 48 is threaded into end bore 19 and provides sealing engagement by means of gasket 49 to provide a fluid-tight enclosure and a device for limiting movement to the right of pilot valve piston 44.

An end cap 50 is threadedly received in inlet bore 14 and is sealed therein by means of gasket 51. End cap 50 includes therein threaded inlet port 52 and further reduced pilot valve stem bore 54 which terminates in normally open pilot valve seat 55. End cap 50 further includes passage 56 providing fluid communication between inlet port 52 and passage 26 with an appropriate seal being provided by internal gasket 58. Pilot valve 60, having stem 61 thereon, is slidably received in pilot valve stem bore 54 and is moveable into engagement with normally open pilot valve seat 55 and normally closed pilot valve seat 64, the latter being formed in valve body 11 at the junction between pilot valve bore 15 and central bore 16.

The electromagnetic solenoid assembly 12 is supported in body member 11 and comprises enclosure tube 66, being a conventional formed thin metal tube secured in place by means of threaded bonnet 68 in the upper vertical bore 21 of valve body 11. Contained within enclosure tube 66 is pole piece 70 which is retained in fixed position by means of rolled in groove 71 and includes conventional shading ring 72 at the lower face thereof. A slidable plunger 74 is received in the lower portion of enclosure tube 66 and carries in a recess at its lower end upper valve element 75 which is an elastomeric disc snapped into plunger 74. As noted in FIG. 1, plunger 74 is biased to a lower position by means of plunger spring 76 so that upper valve element 75 is in engagement with upper valve seat 24. Electromagnetic solenoid assembly 12 further comprises a conventional housing 78, flux frame 79 and coil windings 80, all of which are slidably received on enclosure tube 66 and retained in place by means of snap ring connector 81 which is positioned to be received in the groove 71 at the upper end of enclosure tube 66.

Figure 5:
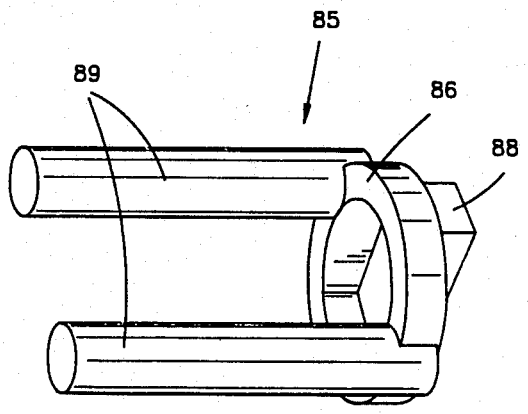
FIG. 5 is a perspective view of the valve holder for the lower, normally open solenoid valve element, removed from the solenoid valve of FIG. 1.

Lower valve seat 25 is formed in valve body 11 in lower vertical bore 22 and a lower valve element 84 is provided for opening and closing fluid flow through lower valve seat 25. Lower valve element 84 is an elastomeric disc received in a disc or valve holder 85, best seen in the perspective view of FIG. 5 as comprising a circular disc receiving portion 86, a lower support 88 and a pair of vertically upwardly extending spaced cylindrical legs 89. Legs 89 are received in bores 90, best seen in FIG. 3, which straddle central bore 16, and which allow legs 89 to engage the lower surface of plunger 74 and valve element 75 therein for common movement therewith. Disc holder 85 is biased upwardly by compression spring 92 into engagement with plunger 74 and is retained in place by means of threaded spring seat closure 94, received in lower vertical bore 22.

Figure 4:
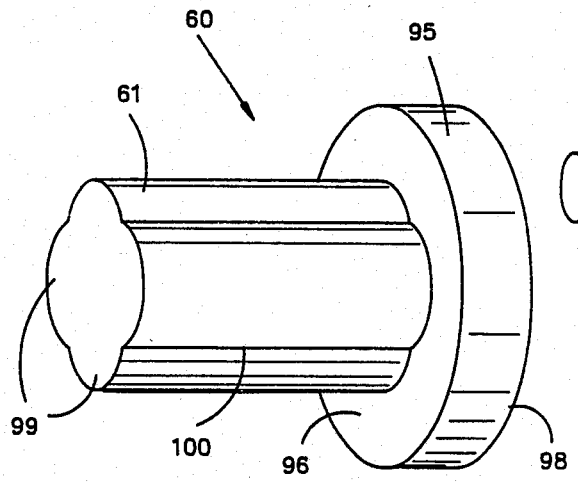
FIG. 4 is a perspective view of the pilot-operated valve element, removed from the solenoid valve of FIG. 1.

With further reference to FIG. 4, it may be seen that pilot valve 60 comprises an elastomeric valve element having a cylindrical head portion 95 including opposed parallel seating pilot valve seat 55 and normally closed pilot seat 64. Stem 61 of pilot valve 60 is integral with cylindrical head 95 thereof, and comprises four generally cylindrical legs 99 joined together in a generally cross-shaped configuration to provide guidance at the periphery of the legs 99 in pilot valve stem bore 54. Suitable clearance is also provided in the recessed spaces 100 between adjacent legs 99 to allow relatively unrestricted fluid flow through pilot valve stem bore 54 and accordingly through normally open pilot valve seat 55 when cylindrical head 95 of pilot valve 60 is in the position depicted in FIG. 1 in engagement with normally closed pilot valve seat 64.

Thus, it will be understood, in the deenergized condition of solenoid valve 10 depicted in FIG. 1, that air under pressure may be directed to inlet port 52 to urge pilot valve 60 to a rightward position in engagement with normally closed pilot valve seat 64 allowing air under pressure to pass through pilot valve stem bore 54 and normally open pilot valve seat 55 into pilot valve bore 15 and accordingly to first cylinder port 30 by way of connecting passage 32. At this time, air under pressure from inlet port 52 will also be supplied by way of passages 56, 26 to upper valve seat 24, but this will be closed by upper valve element 75, being biased to the closed position by plunger return spring 76. Return fluid from a fluid cylinder or the like connected to the cylinder ports 30, 31 will be received at second cylinder port 31 and routed by means of restricted cylinder passage 40 to upper vertical bore 21 and then by means of vertical connecting passage 28 to lower vertical bore 22 to be exhausted by way of lower valve seat 25, central bore 16 and exhaust port 35. In this condition, lower valve element 84 is spaced from lower valve seat 25 in that disc valve holder 85 is moved downwardly against the bias of return spring 92 through the intermediacy of valve holder legs 89 and the force of plunger return spring 76.

When coil windings 80 are energized by means of electric current, plunger 74 will be drawn upwardly in enclosure tube 66 into engagement with pole piece 70 against the bias of return spring 76. This movement will open upper valve seat 24 and lower valve element 84 will be biased against lower valve seat 25 to close the same by means of the urging of lower spring 92. In this operating condition, fluid under pressure received at inlet port 52 will be received in upper vertical bore 21 and communicated by way of restricted passage 40 to second cylinder port 31 and simultaneously by means of enlarged passage 41 to piston bore 18. With fluid under pressure applied to the piston U-cup 46 of pilot valve piston 44, the latter will be urged to the left in bore 18 so that the stem 45 thereof engages pilot valve 60 to move the latter leftwardly into engagement with normally open pilot valve seat 55, closing the latter and preventing fluid communication through pilot valve stem bore 54. At this time return fluid received at first cylinder port 30 is applied to pilot valve bore 15 by means of communicating passage 32 and exhausted through central bore 16, communicating passage 36 and exhaust port 35. This condition will be maintained so long as coil windings 80 are energized by electric current.

In completion of the operating cycle, when coil 80 is deenergized, return spring 76 will urge plunger 74 downwardly to close upper valve seat 24 and open lower valve seat 25 preventing further fluid under pressure being applied by way of connecting passage 41 to pilot valve piston 44. Piston 44 will be urged to the right under the force supplied by pilot valve 60 until such condition is reached wherein normally closed pilot valve seat 64 is again sealed by fluid under pressure applied to first cylinder port 30. As noted, since pilot valve 60 is guided for movement in pilot valve stem bore 54 by means of the cylindrical legs 99, a firm and repeatable engagement of sealing faces 96, 98 can be made with the respective valve seats 55, 64. Further, because pilot valve 60 is guided in its movement, substantially the same fluid flow will occur through the recesses 100 between legs 99 of the valve stem 61 and cylindrical head 95 will not be shifted radially to affect flow through the adjacent passage 32 which laterally enters pilot valve bore 15.

I claim:

1. A semi-pilot operated four-way valve, comprising a valve body having a stepped cylindrical bore extending along a horizontal axis and including a pilot valve bore and piston bore adjacent a central bore, an inlet port in said valve body in normally open fluid communication with said pilot valve bore, an exhaust port in said valve body in fluid communication with said central bore, normally closed and normally open pilot valve seats in said pilot valve bore, a first cylinder port in said valve body in fluid communication with said pilot valve bore, a pilot valve in said pilot valve bore moveable between positions closing said normally open and normally closed pilot valve seats, said pilot valve being biased to a position closing said normally closed pilot valve seat in response to fluid pressure applied at said inlet port, a pilot valve piston in said pilot valve piston bore having a stem slidably received in said central bore and engageable with said pilot valve for moving said pilot valve to a position closing said normally open pilot valve seat, an upper vertical bore in said valve body having a first direct-operated valve seat therein in fluid communication with said inlet port, a lower vertical bore in said valve body having a second direct-operated valve seat therein in fluid communication with said central bore, a second cylinder port in said valve body in fluid communication with said upper bore, said pilot valve piston bore being in fluid communication with said upper bore, a magnetically actuated solenoid plunger operable to move upper and lower valves relative to said upper and lower valve seats thereby alternately connecting said first and second cylinder ports with said inlet and exhaust ports for changing fluid flow through said valve, spring means for biasing said upper valve relative to said first direct valve seat, and a valve holder supporting said lower valve relative to said second direct valve seat, said valve holder being coupled to said upper valve for movement therewith, said upper valve being a normally closed valve, said first direct valve seat being formed in said upper vertical bore in said valve body, said lower valve being a normally open valve cooperative with said second direct valve seat formed in said lower vertical bore in said valve body, said valve holder comprising a unitary element having a circular recess at the lower portion thereof for support of a lower valve disc and a pair of spaced upwardly extending legs, said legs straddling said central bore and engageable with said upper valve for movement therewith.

2. The valve as set forth in claim 1 wherein said pilot valve comprises an integral elastomeric valve disc and valve stem, said valve stem supporting said valve disc for axial movement between said normally open and normally closed valve seats.

3. The valve as set forth in claim 2 wherein said valve stem is a cross-shaped projection having plural equally spaced integral legs.

4. The valve as set forth in claim 2 wherein an end cap is threadedly received in said inlet port, said end cap being internally threaded and having a central bore terminating in said normally open pilot valve seat, said valve stem being slidably received in said central bore.

* * * * *